US005385520A

United States Patent [19]

Lepine et al.

[11] Patent Number: 5,385,520

[45] Date of Patent: Jan. 31, 1995

[54] ICE SKATING TREADMILL

[75] Inventors: James J. Lepine; John P. Frappier, both of Fargo, N. Dak.

[73] Assignee: Hockey Acceleration, Inc., Fargo, N. Dak.

[21] Appl. No.: 183,294

[22] Filed: Jan. 18, 1994

Related U.S. Application Data

[63] Continuation of Ser. No. 890,536, May 28, 1992, abandoned.

[51] Int. Cl.[6] ..... A63B 22/02

[52] U.S. Cl. ..... 482/54; 482/51

[58] Field of Search ..... 482/54, 51; 472/90; 198/803.2, 850

[56] References Cited

U.S. PATENT DOCUMENTS

| | | | |
|---|---|---|---|
| 3,202,266 | 8/1965 | Schmermund | 198/850 |
| 3,771,891 | 11/1973 | Nirenski et al. | 472/90 |
| 3,976,192 | 8/1976 | Muller | 198/850 |
| 4,350,336 | 9/1982 | Hanford | 482/54 |
| 4,423,864 | 1/1984 | Wilk | 482/71 |
| 4,579,335 | 4/1986 | Centafanti | 482/54 |
| 4,614,337 | 9/1986 | Schonenberger | 482/54 |
| 4,678,078 | 7/1987 | Hastem-Muller | 198/803.2 |
| 4,886,266 | 12/1989 | Trulaske | 482/54 |
| 5,018,722 | 5/1991 | Whitmore | 482/54 |

FOREIGN PATENT DOCUMENTS

| | | | |
|---|---|---|---|
| 0235030 | 4/1986 | Germany | 482/54 |
| 2152825 | 8/1985 | United Kingdom | 482/54 |

*Primary Examiner*—Richard J. Apley
*Assistant Examiner*—Lynne A. Reichard
*Attorney, Agent, or Firm*—Faegre & Benson

[57] ABSTRACT

An artificial ice skating treadmill for forward and backward ice skating, specifically designed to allow an ice skater to practice normal ice skating behavior while in a relatively fixed position. The general elements of the present design allow for the ice skater's form to be observed and coached from very close range, thus promoting rapid improvement in technique. The present ice skating treadmill allows for uphill or downhill skating, thus causing rapid loading of specific muscle groups and in turn the strengthening of those groups. A variable speed element in the present ice skating treadmill also allows muscle group conditioning at all skating speeds.

The essential features of the present apparatus are the support base with a screw type tilt mechanism. The platform consists of two side rails, two roller drums, an endless belt covered with ridged slats of plastic, a variable speed drive system, a remote electrical enclosure housing an inverter and the necessary electrical devices, and a remote control panel.

13 Claims, 3 Drawing Sheets

ICE SKATING TREADMILL

This is a continuation of U.S. Pat. application Ser. No. 07/890,536 filed May 28, 1992 now abandoned.

BACKGROUND OF THE INVENTION

The protocol for the correct biomechanics of ice skating necessitates the close observation and evaluation of hip girdle functions (i.e., flexion, extension, abduction and adduction). These functions can best be observed with an ice skater in a fixed position like a runner on a standard treadmill. The protocol requires a situation that matches natural ice in all aspects. The ice skating treadmill must also provide the capability to properly load the lower extremities in a correct biomechanical position, as well as provide for appropriate proprioceptive neuromuscular facilitation and overload principles within the specific musculature. The device must incorporate safety features such as an overhead supported harness to keep the skater from falling yet providing contact with the plastic surface. A safe secure platform must also be provided for the observer.

SUMMARY OF THE INVENTION

By the present invention, an apparatus has been devised that duplicates actual ice skating conditions on a treadmill, thus allowing close observation of the biomechanical functions of an ice skater in a safe and convenient manner.

This apparatus comprises the following components:

A. A support base frame providing screw mechanisms which give the skating deck negative or positive incline.

B. A skating deck consisting of a frame which supports drive and idler rollers and a belt system consisting of an endless belt with artificial ice surface slats fastened to it. Also included are surface support rollers and an electric motor drive.

C. An electrical cabinet housing an inverter, resistors, and necessary electrical components.

D. A control panel containing speed, % of grade, and start, stop, and control switches.

The uniqueness of this machine will become readily apparent from the ensuing description.

DETAILED DESCRIPTION OF THE INVENTION

Figure 1:
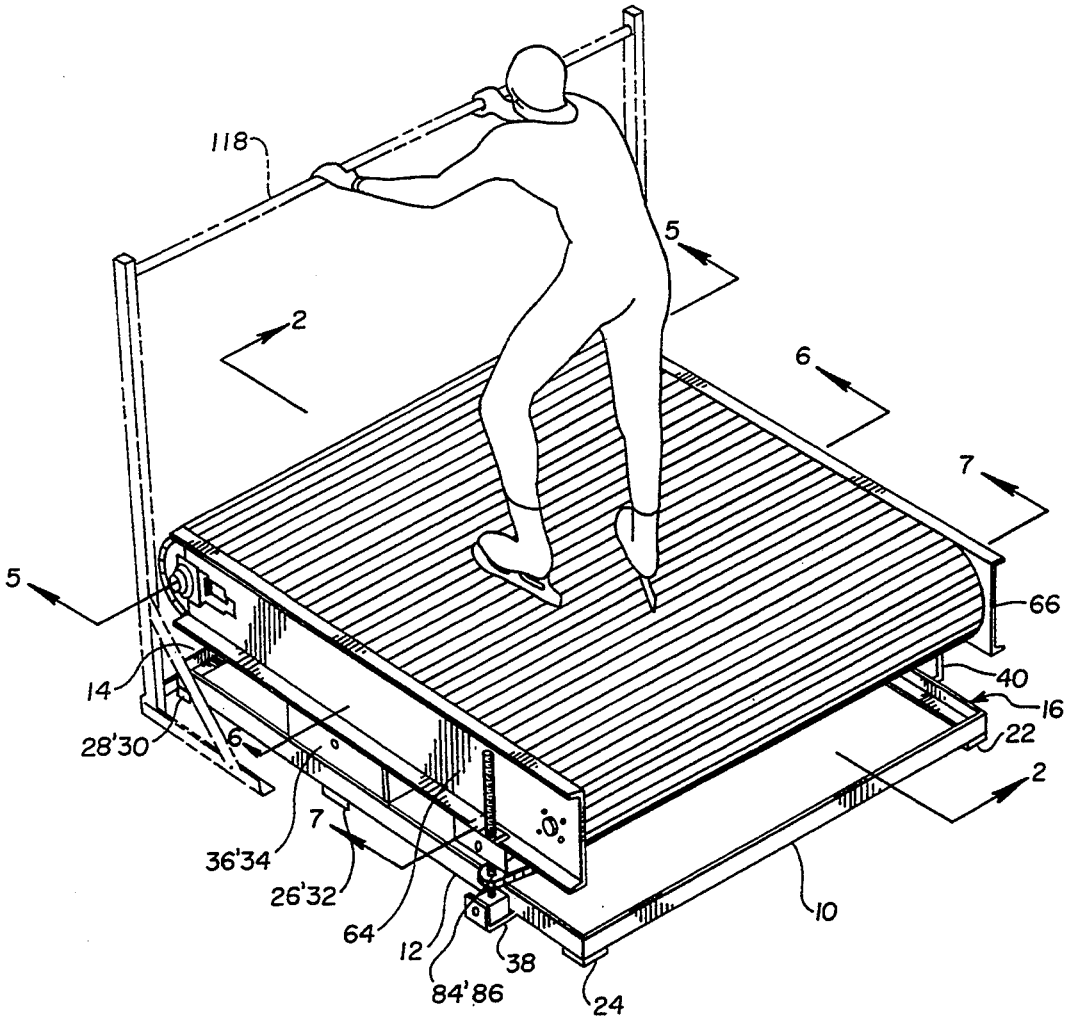
FIG. 1 is a perspective view of the ice skating treadmill of the present invention in use by a skater.

The apparatus of the invention is designed primarily for the purpose of duplicating ice skating behavior in a fixed position. The principle of the system relies on the fact that a convenient surface with the same characteristics as a natural ice surface, moving as an endless belt, will allow natural ice skating behavior in a fixed position. To accomplish this, the following four part system is utilized:

1. As shown in FIGS. 1, 2 and 5–7, the support base frame consists of outer rails 10 through 16, cross rails 18 and 20 and leveling pads 22 through 32. This frame supports the skating deck pivot supports 34 and 36. The frame also supports the lifting mechanism support weldments 38 and 40 and motor drive mount supports 42 and 44.

The lifting mechanism consists of an electric motor gear drive unit 46, screw block mechanisms 48, 50 and synchronous chains and sprockets 52, 54; idlers to tension drive chains and polyethylene support pads to keep chains from sagging may also be provided. This mechanism is remotely controlled to raise or lower the skate deck to any desired angle of inclination.

2. The skating deck, as shown in FIGS. 1, 2 and 5–7, consists of structural side rails 64, 66. These are supported by cross supports 68, 70 and subsequently may also be further supported by sub supports. The side rails mount to the base frame at hinge points 76, 78 with hinge pins 80, 82. The lifting mechanism attaches to the side rails with pivot yokes 84 and 86 thus providing a tilting unit. A belt drive drum 88 is attached to the side rails with bearings 90 and shaft 92.

The belt drive drum is rotated by means of a drive motor 94 using pulleys and belt sets in a conventional manner.

Figure 4:
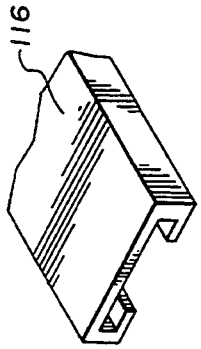
FIG. 4 is a fragmentary perspective detail showing a track slat.
Figure 3:
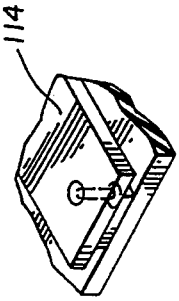
FIG. 3 is a fragmentary perspective detail showing the base track and a slat key.
Figure 2:
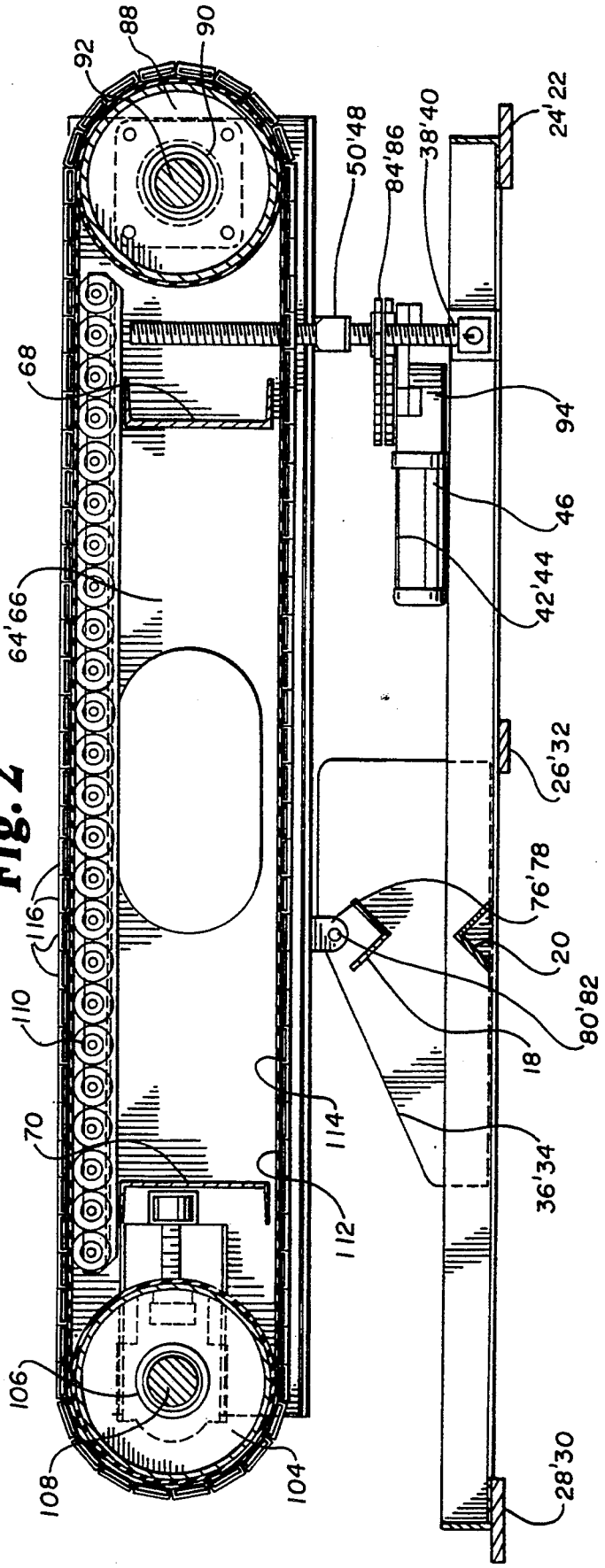
FIG. 2 is a longitudinal section thereof.
Figure 5:
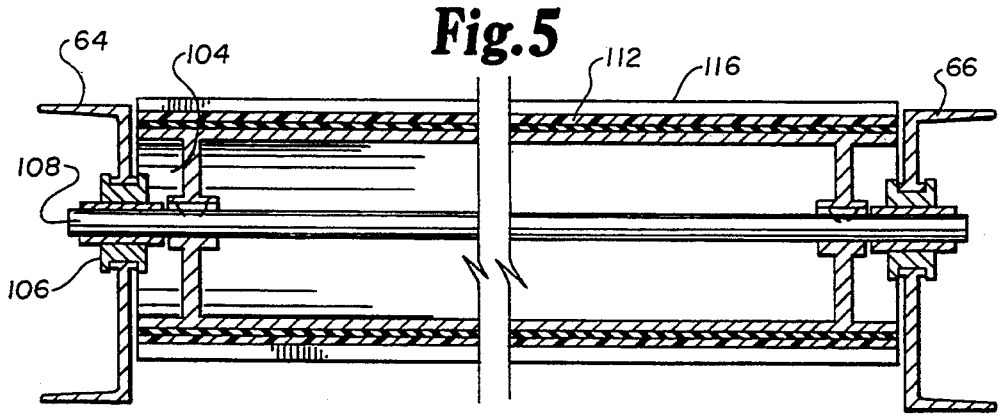
FIG. 5 is a transverse section of the ice skating treadmill taken along line 5—5 of FIG. 1.
Figure 6:
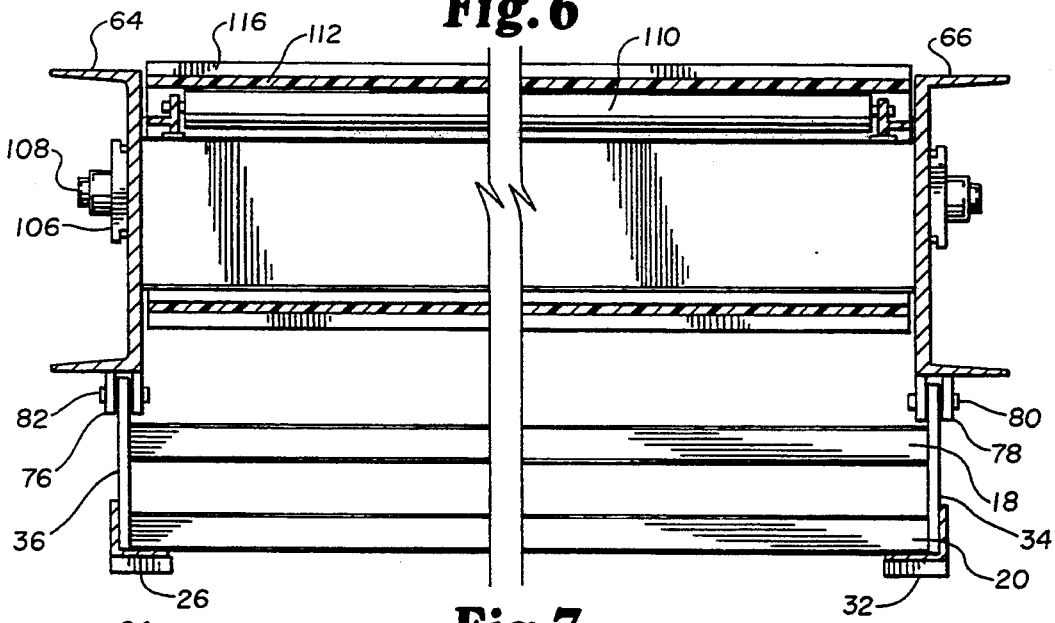
FIG. 6 is a transverse section taken along line 6—6 of FIG. 1.
Figure 7:
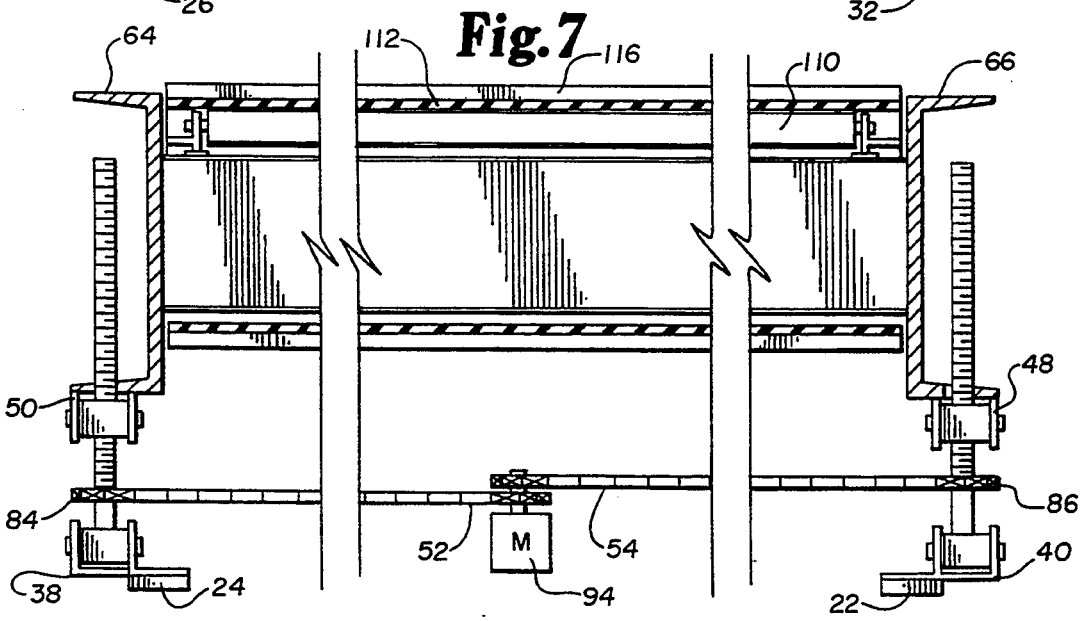
FIG. 7 is a transverse section taken along line 7—7 of FIG. 1.

The belt idler drum 104 is attached to the side rails by means of take up bearing assembles 106 and shaft 108. The take up bearings are used to tension the main belt. Three to five rows of support rollers 110 are mounted along the length of the support frame to provide rolling support for the entire skating surface and are staggered to give the belt a flat, smooth bed on which to run. The main belt 112 is a rubberized polyester material with a vulcanized seam and is fitted with aluminum tee lock brackets 114 (see details of FIGS. 3 and 4) by means of flat head bolts or rivets through the belt and fastened into the locks. Unique slats 116 are machined from high density, high molecular weight polyethylene to slide over the tee lock brackets and butt together forming a flat smooth surface while in a level configuration and yet have the flexibility to articulate individually when the belt moves around the drums. The tee lock method of fastening is strong enough to overcome the centrifugal force exerted on the slats during high speed operation. The surface is lubricated with silicone lubricant to provide a coefficient of friction similar to a natural ice surface. A handrail 118 may be provided if necessary across the front of the machine to provide for a safe and comfortable egress.

Further features may be added to provide for the safety and facility of the skater. For example, a continuous loop track system can also be mounted overhead if desired to allow a trolley to be attached. This trolley in turn may have a suitable lanyard and harness limiting the movement of the skater, to keep the skater from falling to the surface, while allowing free skating motion and a convenient method of access to the surface.

Electrical, safety and operational controls of a conventional nature may be included. For example, an electrical cabinet may be provided to house the inverter used to control the belt drive motor and vary the speed in both forward and reverse rotation, and the necessary relays and resistors for system operation. A control panel may be used to incorporate main power switches, an emergency stop switch, a digital speed indicator and a digital elevation indicator. Further features which may also be included are right and left belt track fault indicator lamps, to indicate when the belt over tracks to one side. A drive fault indicator lamp may be used to signal a drive problem. A belt start/stop switch may be used to activate the running belt, while the rotary switch can be used to select the desired belt speed. Two elevation switches can be provided to raise or lower the platform to the desired elevation.

What is claimed is:

1. An ice skating treadmill comprising in combination:

a base frame having a skating deck lifting mechanism;

a skating deck having side rails supported in parallel and apart from each other, said side rails mounted to the lifting mechanism of the base frame by a hinged support means, thus providing a tiltable skating deck, a belt drive drum operably attached by a drive shaft between the side rails rotatable by means of a drive motor;

and a main belt engaged by said drive drum to rotate around said drive drum, said belt fitted with T-lock brackets arranged parallel to each other and perpendicular to a direction of rotation of said belt, said T-lock brackets each slidingly engaging T-lock channeled slats allowing the slats to individually articulate as the belt rotates around the drive drum, edges of said slats abutting together while in a level configuration and forming a flat smooth high density ice skating surface, the skating surface having a lubricant to provide a coefficient of friction approximately the same as that of a natural ice surface.

2. An ice skating treadmill comprising in combination:

a base frame having a lubricant to provide a skating deck lifting mechanism, said lifting mechanism including an electric motor gear drive unit, a screw block mechanism, and synchronous chains and sprockets; a skating deck having side rails supported in parallel and apart from each other by cross supports, said side rails mounted to the base frame by hinged support means, said lifting mechanism attached to opposite side rails with a pivot yoke means, thus providing a tiltable skating deck, a belt drive drum operably attached by a shaft between the side rails at a proximal end of said side rails, the belt drive drum rotatable by means of a drive motor, said belt drive motor controlled by an inverter to control speed and direction of belt rotation, support rollers mounted along the side rails to provide rotational support for a skating surface;

and a main belt fitted with T-lock brackets arranged parallel to each other and perpendicular to a direction of rotation of said belt, said T-lock brackets each slidingly engaging high-density T-lock channeled slats, edges of said slats abutting together while in a level configuration and forming a flat smooth high density ice skating surface, having flexibility to articulate around each drum and having a coefficient of friction approximately the same as that of a natural ice surface.

3. An ice skating treadmill according to claim 2, the base frame further comprising parallel spaced apart outer rails, cross rails, which are parallel to each other and perpendicular to the outer rails, and levelling pads.

4. An ice skating treadmill according to claim 1, the skating deck further comprising three to five rows of support rollers mounted along the length of the support frame to provide rolling support for the skating surface and are staggered to provide a flat smooth bed for the belt.

5. An ice skating treadmill according to claim 1, wherein the main belt is rubberized polyester with vulcanized seams, and wherein the T-lock brackets are formed of aluminum and are attached to the belt by means of flat head bolts or rivets through the belt and fastened into the T-lock brackets.

6. An ice skating treadmill according to claim 1, wherein the slats are machined from high-density, high molecular weight polyethylene.

7. An ice skating treadmill according to claim 1, wherein a handrail is provided across a forward end of the treadmill.

8. An ice skating treadmill comprising in combination:

a base frame for supporting a continuous skating deck, said skating deck operatively coupled to a drive means for rotation thereby, said skating deck formed of interengaging, individually articulable high-density slats oriented perpendicular to a direction of rotation of said deck, said slats abutting while in a level configuration and together forming a flat smooth hard and high-density ice skating surface having a lubricant to provide a coefficient of friction approximately the same as that of a natural ice surface.

9. An ice skating treadmill according to claim 8, wherein the slats are machined from high density, high molecular weight polyethylene.

10. In a treadmill of the type comprising:

a base frame having a treadmill deck lifting mechanism;

a treadmill deck having side rails supported in parallel and apart from each other, said side rails mounted to the lifting mechanism of the base frame by a hinged support means, thus providing a tiltable treadmill deck, a belt drive drum operably attached by a drive shaft at a proximal end of the skating deck and between the side rails rotatable by means of a drive motor; and a main belt engaged by said drive drum to rotate around said drive drum, said belt fitted with T-lock brackets arranged parallel to each other and perpendicular to a direction of rotation of said belt, said T-lock brackets each slidingly engaging T-lock channeled slats and allowing the slats to individually articulate as the belt rotates, said slats together forming a treadmill surface;

the improvement comprising:

said slats formed of a high-density material and abutting together while in a level configuration and forming a flat smooth and hard treadmill surface having a lubricant to provide a coefficient of friction approximately the same as that of a natural ice surface.

11. The invention as described in claim 10, wherein the slats are machined of high density, high molecular weight polyethylene.

12. In a treadmill of the type comprising:

a base frame having a treadmill deck lifting mechanism, said lifting mechanism including an electric motor gear drive unit, a screw block mechanism, and synchronous chains and sprockets;

a treadmill deck having side rails supported in parallel and apart from each other by cross supports, said side rails mounted to the base frame by hinged support means, said lifting mechanism attached to opposite side rails with a pivot yoke means, thus providing a tiltable treadmill deck, a belt drive drum operably attached by a shaft between the side rails at a proximal end of said side rails, the belt drive drum rotatable by means of a drive motor, said belt drive motor controlled by an inverter to control speed and direction of belt rotation, a rotatable belt idler drum attached between the side rails and at a distal end of the skating deck, support rollers mounted along the side rails to provide rotational support for a treadmill surface; and a main belt fitted with T-lock brackets arranged parallel to each other and perpendicular to a direction of rotation of said belt, said T-lock brackets each slidingly engaging T-lock channeled slats, said slats together forming a treadmill surface having flexibility to articulate around each drum;

the improvement comprising:

said slats formed of a hard, high-density material and abutting together while in a level configuration and in an area of the belt intermediate the drive drum and the idler drum and forming a flat smooth and hard treadmill surface having a coefficient of friction approximately the same as that of a natural ice surface.

13. The invention as described in claim 12, wherein the slats are machined of high density, high molecular weight polyethylene, the treadmill surface being lubricated with a silicone lubricant.

* * * * *

UNITED STATES PATENT AND TRADEMARK OFFICE

CERTIFICATE OF CORRECTION

PATENT NO. : 5,385,520

DATED : January 31, 1995

INVENTOR(S) : James J. Lepine; John P. Frappier

It is certified that error appears in the above-identified patent and that said Letters Patent is hereby corrected as shown below:

In Col. 3, Line 39, the words "a lubricant to provide" should be deleted

In Col. 3, Line 66, after "and having" --a lubricant to provide-- should be inserted Signed and Sealed this Twentieth Day of August, 1996

*Attest:*

*Attesting Officer*

BRUCE LEHMAN

*Commissioner of Patents and Trademarks*